US006203302B1

(12) United States Patent
Maki

(10) Patent No.: US 6,203,302 B1
(45) Date of Patent: Mar. 20, 2001

(54) RUBBER IMPELLER PUMP

(75) Inventor: Bruce A. Maki, Hugo, MN (US)

(73) Assignee: Hypro Corporation, New Brighton, MN (US)

( * ) Notice: Subject to any disclaimer, the term of this patent is extended or adjusted under 35 U.S.C. 154(b) by 0 days.

(21) Appl. No.: 09/172,816

(22) Filed: Oct. 15, 1998

(51) Int. Cl.[7] ..... F03C 2/00

(52) U.S. Cl. ..... 418/154; 418/156; 418/253; 418/256

(58) Field of Search ..... 418/154, 156, 418/256, 253

(56) References Cited

U.S. PATENT DOCUMENTS

| | | | | |
|---|---|---|---|---|
| 2,052,474 | | 8/1936 | Johnson . | |
| 2,070,738 | | 2/1937 | Klein . | |
| 2,336,580 | | 12/1943 | Yeatman . | |
| 2,455,194 | | 11/1948 | Rumsey . | |
| 2,466,440 | * | 4/1949 | Kiekhaefer | 418/154 |
| 2,971,469 | * | 2/1961 | McLean | 418/154 |
| 3,218,983 | * | 11/1965 | Parrett | 418/154 |
| 3,240,154 | * | 3/1966 | Robbins | 418/154 |
| 3,829,248 | * | 8/1974 | Bright et al. | 418/154 |
| 3,832,105 | * | 8/1974 | Takahashi | 418/154 |
| 4,004,865 | | 1/1977 | Ikeda et al. . | |
| 4,392,779 | * | 7/1983 | Bloemers et al. | 418/154 |
| 4,435,138 | * | 3/1984 | Johnson | 418/256 |
| 4,443,167 | | 4/1984 | Stageberg et al. . | |
| 4,940,402 | | 7/1990 | McCormick . | |
| 4,958,992 | * | 9/1990 | Winiger | 418/256 |
| 5,660,536 | * | 8/1997 | Karls et al. | 418/154 |

FOREIGN PATENT DOCUMENTS

| | | | | |
|---|---|---|---|---|
| 657779 | * | 2/1963 | (CA) | 103/42 |
| 1-75290 | * | 8/1986 | (JP) | 415/154 |

* cited by examiner

*Primary Examiner*—Thomas Denion
*Assistant Examiner*—Theresa Trieu
(74) *Attorney, Agent, or Firm*—Nikolai, Mersereau & Dietz, P.A.

(57) ABSTRACT

A high pressure fluid forcing pump having a cavity adaptable for receiving an impeller assembly rotatable within the cavity of the pump. The impeller assembly includes an impeller engaged between first and second spaced apart bearing plates and having tips fixed to the bearing plates adjacent an outer circumference of the bearing plates. The impeller includes a locking arrangement that ensures that the impeller rotates about a motor shaft of the pump. The shaft is positioned in the cavity of the housing, wherein the rotational axis of the shaft and impeller are offset from the longitudinal axis of the cavity and first and second bearing plates.

13 Claims, 4 Drawing Sheets

RUBBER IMPELLER PUMP

BACKGROUND OF THE INVENTION

I. Field of the Invention

This invention relates generally to a fluid forcing pump, and more particularly relates to a fluid forcing pump operable at high pressures. The fluid forcing pump of the present invention includes a housing having a cavity formed therein, wherein the cavity is adapted for receiving a cylindrical rubber impeller assembly of the present invention. The longitudinal axis of the cylindrical rubber impeller assembly and the longitudinal axis of the cavity are offset or eccentric, such that as the cylindrical impeller assembly rotates within the cavity, fluids are displaced through a fluid outlet.

II. Discussion of the Related Art

Various conventional rubber impeller pumps have been devised having the ability to pump fluids without a pulsating affect. These conventional rubber impeller pumps typically operate at low pressures and may suffer from high amounts of internal slip, particularly under relatively modest output pressures. The conventional rubber pump rotates a rubber impeller within a cylindrical cavity of a housing, wherein the rotation axis of the impeller is offset from the longitudinal axis of the cylindrical housing (commonly referred to as eccentricity). When the impeller rotates within the cavity of the housing, during a portion of the rotation, the blades are deformed due to the offset or eccentricity between the rotation axis and the housing axis. The blades are typically sized such that blade tips contact the internal wall through the entire revolution of the impeller. Although the blades contact the housing wall, the blades in an eccentric system may deform away from the housing wall allowing fluids to pass between the blades and the housing wall. In order to maintain contact between the conventional blade and the housing wall, the impeller is typically constructed having an outer diameter greater the diameter of the housing bore plus the length of offset. Additionally, the conventional blades may be lengthened to provide an additional "squeeze" by the blades against the housing wall. The pressure limitations of the conventional impeller is limited to the mechanical properties of the material used to construct the impeller. Once the force of the fluid pressure exceeds the mechanical properties of the blade of the conventional impeller, then the blades will disengage from the housing wall, thereby allowing high rates of internal slippage to occur.

The required flexibility of the blades further limits the suitable materials used to manufacture the flexible impeller. The blades of the conventional impeller must be manufactured from a material having resilient properties which allow repetitious bending of the blades of the impeller. Thus, the material selection for the manufacture of a conventional impeller having resilient blades is almost exclusively restricted to elastomers such as neoprene, Buna-N and EPDM. Impellers manufactured from these materials are typically limited to low pressure fluid transfer and circulation applications.

Exemplary of such rubber impeller pumps are those described by E.C. Rumsey in U.S. Pat. No. 2,455,194, Takahashi in U.S. Pat. No. 3,832,105, and McCormick in U.S. Pat. No. 4,940,402. Both Rumsey and McCormick describe rubber impellers having weights secured to the end of each blade. In this manner, the weight is intended to keep the end of the blade in contact with the housing wall as pressure against the blades increases. As the rotation speed of the impeller increases, fluid tends to pass between the impeller and the housing wall limiting the effective speed and maximum operating pressure of the pump. Hence, there is a need for a pump and impeller assembly that may effectively operate at increased rotational speeds and pressure.

Rumsey also describes a slot formed in a central bore of the impeller and a mating rib formed on the shaft of the pump. The impeller is placed on the shaft such that the rib on the pump shaft fits into the slot formed in the central bore of the impeller. Although this "keying" arrangement is intended to reduce the amount the impeller slips on the shaft as the shaft rotates, as the revolutions per minute of the shaft and pressure within the housing increase, the slot may tend to slip over the rib and the impeller may rotate on the shaft. Thus, the effectiveness of this keying arrangement may be dependent upon the speed at which the impeller is rotated and the rigidity of the material used to manufacture the impeller.

Takahashi describes a device that apparently includes a flexible impeller sandwiched between two plates. The impeller is attached to the shaft of the pump, wherein the rotation axis of the impeller is aligned with the rotation axis of the pump shaft. The rotation axis of the pump shaft is offset from the longitudinal axis of the bore formed in the housing. The plates are shown either rotating on a bearing surface or are suspended within the housing such that a portion of the plates bore contacts the pump shaft. The inner surface of the bore on which each plate rotates is subjected to wear and the speed and pressure at which the pump operates may be limited. The blade tips of the impeller slip within slots formed in the plates, such that the plates do not rotate simultaneously with the impellers. Slippage of the blade tips within the slots further limits the pressures at which the Takahashi pump is operable. Hence, there is a need for a rubber impeller pump operable at high speeds and pressures. The present invention addresses these and other needs.

SUMMARY OF THE INVENTION

The purpose of the present invention is to provide a rubber impeller pump that operates efficiently under increased pressure, and which allows for a wider range of materials suitable for construction of the impeller assembly. In accordance with the purpose of the present invention, the high fluid forcing pump generally includes a motor or bearing shaft assembly attached to a housing. The motor includes a rotatable shaft sealably engaged and extending into the housing. The housing has a cavity adapted for receiving a generally cylindrical impeller assembly therein. The longitudinal axis of the rotatable shaft is offset from the center of the cavity and the impeller assembly rotates on the shaft. A spaced apart inlet and outlet extend from an outer surface of the housing into the cavity of the housing. The impeller assembly engages an internal sidewall of the cavity adjacent the fluid outlet of the housing, such that the fluid pressure is greater at the outlet as compared with fluid pressure adjacent the inlet.

The impeller assembly is operable at high rotation speeds and pressures. The impeller assembly includes an impeller having a central hub and a plurality of vanes extending radially from said central hub. The impeller includes a locking arrangement that locks the impeller on the shaft of the pump and inhibits the impeller from slipping on the shaft as the rotational speed and pressure within the cavity are increased. The impeller blade tips are supported by pins which lock or fix the tips to adjacent bearing plates. This locking arrangement mechanically keeps the blade ends in contact with the housing without slippage, allowing the impeller to operate at increased pressures over the conventional impeller technology.

OBJECTS

It is accordingly a principal object of the present invention to provide a high pressure fluid forcing pump having an impeller assembly operable at high rotational speeds and pressure without the slippage associated with the conventional impeller technology;

Another object of the present invention is to provide a high pressure impeller fluid forcing pump suitable for manufacture from a variety of rubber compounds and flexible materials.

Yet another object of the present invention is to provide a high pressure fluid forcing pump having an impeller assembly that reduces the likelihood of slippage about the pump motor's shaft;

A further object of the present invention is to provide an impeller assembly that minimizes the slippage between the impeller and housing wall as the pressure within the housing increases.

Still another object of the present invention is to provide a high pressure fluid forcing pump suitable for use with fluids having a variety of viscosities.

These and other objects and advantages of the present invention will become readily apparent to those skilled in the art from a review of the following detailed description of the preferred embodiment especially when considered in conjunction with the claims and accompanying drawings in which like numerals in the several views refer to corresponding parts.

DETAILED DESCRIPTION

Figure 1:
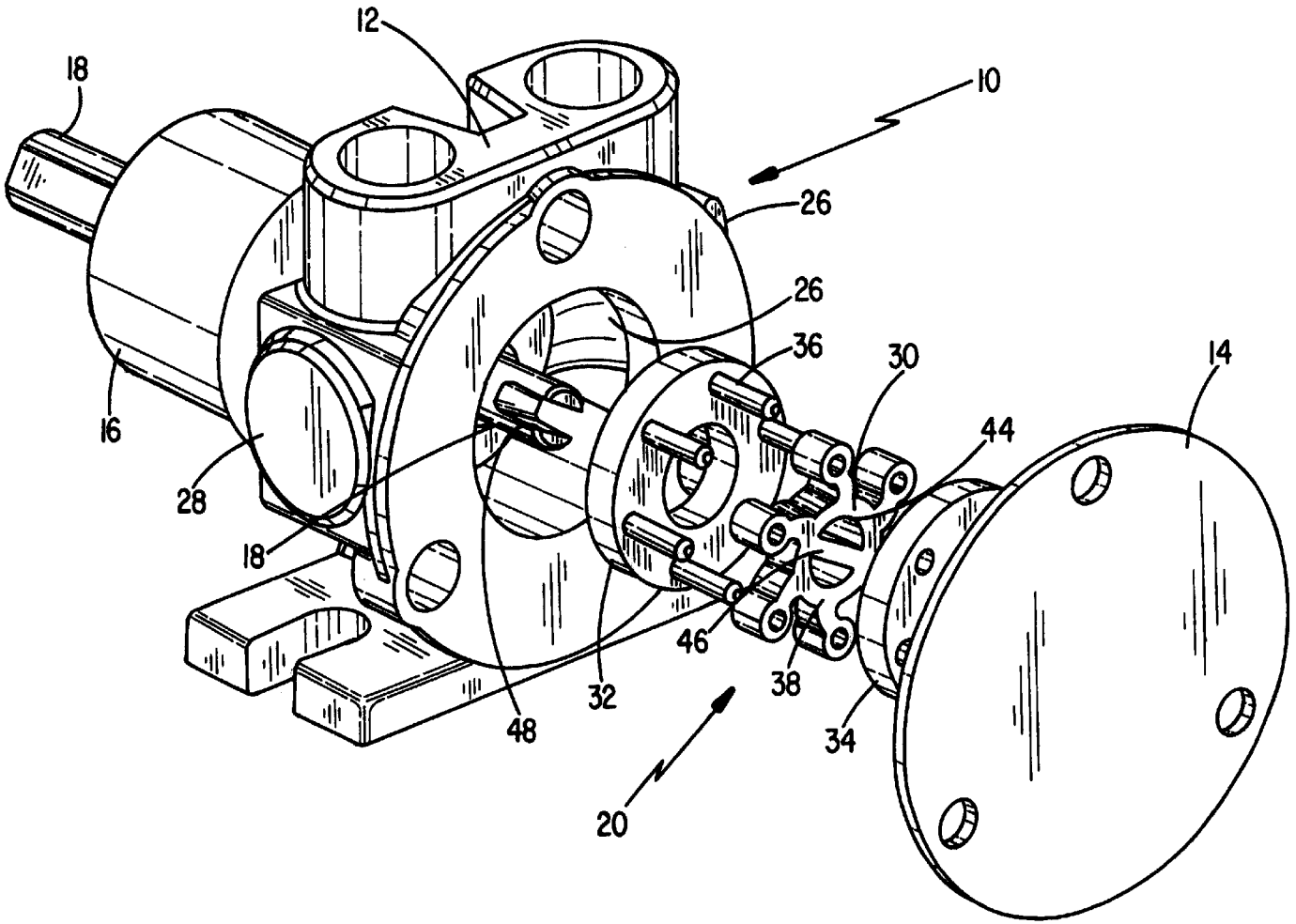
FIG. 1 is a partially exploded perspective view of the high pressure fluid forcing pump and impeller assembly of the present invention.

Referring first to FIG. 1, there is shown generally the high pressure fluid forcing pump 10 of the present invention. The fluid forcing pump 10 includes a housing 12, cover 14, motor 16, rotational shaft 18, and impeller assembly 20. The cover 14 is sealably attached to the housing in a conventional known manner and the motor 16 is of a known suitable construction. The housing 12 has a cavity 22 formed therein, having an internal sidewall 24 defining the perimeter of the cavity 22. A spaced apart inlet 26 and outlet 28 extend from an outer surface of the housing 12 into the sidewall 24 of the housing 12. The impeller assembly 20 engages the shaft 18 and is rotated within the cavity 22 by shaft 18.

Figure 2:
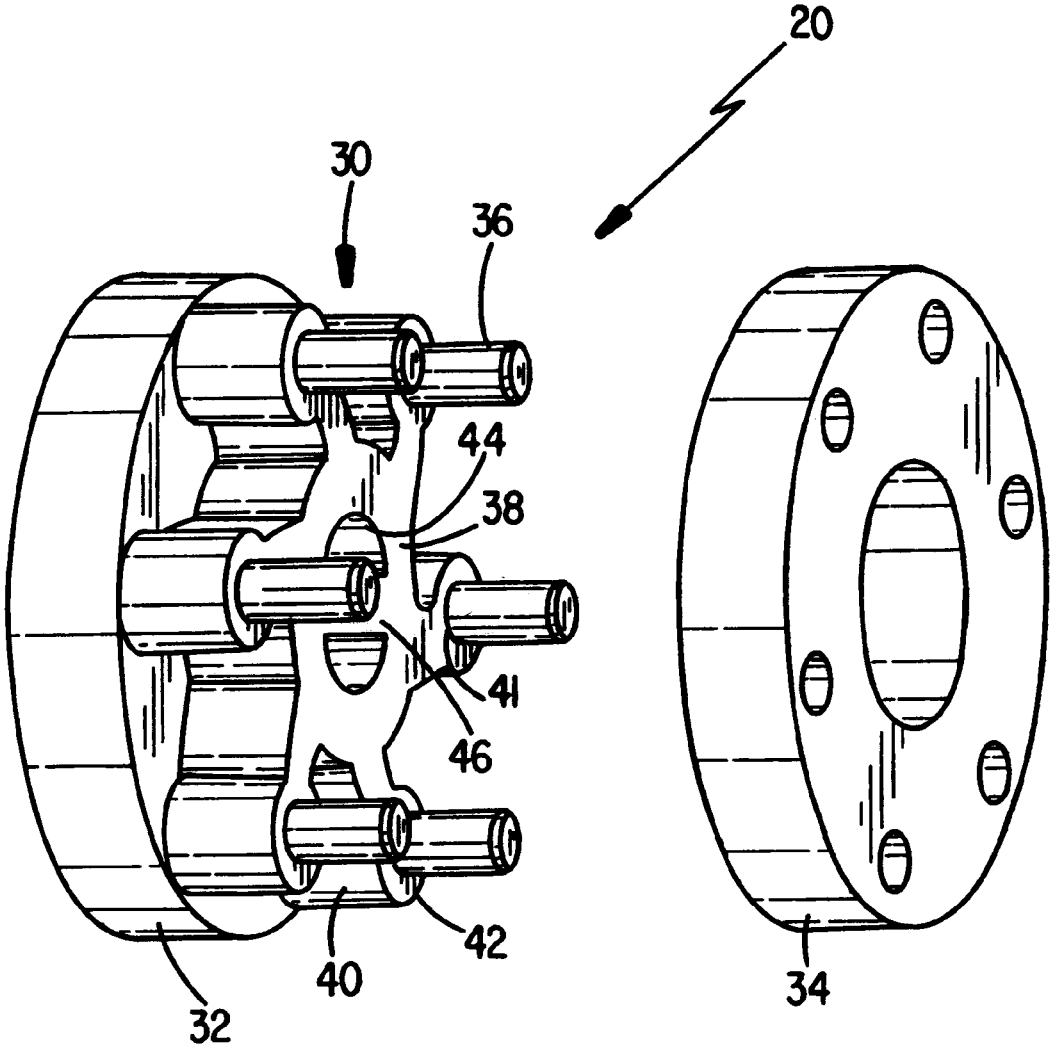
FIG. 2 is a partially exploded perspective view of the impeller assembly of the type shown in FIG. 1.
Figure 3:
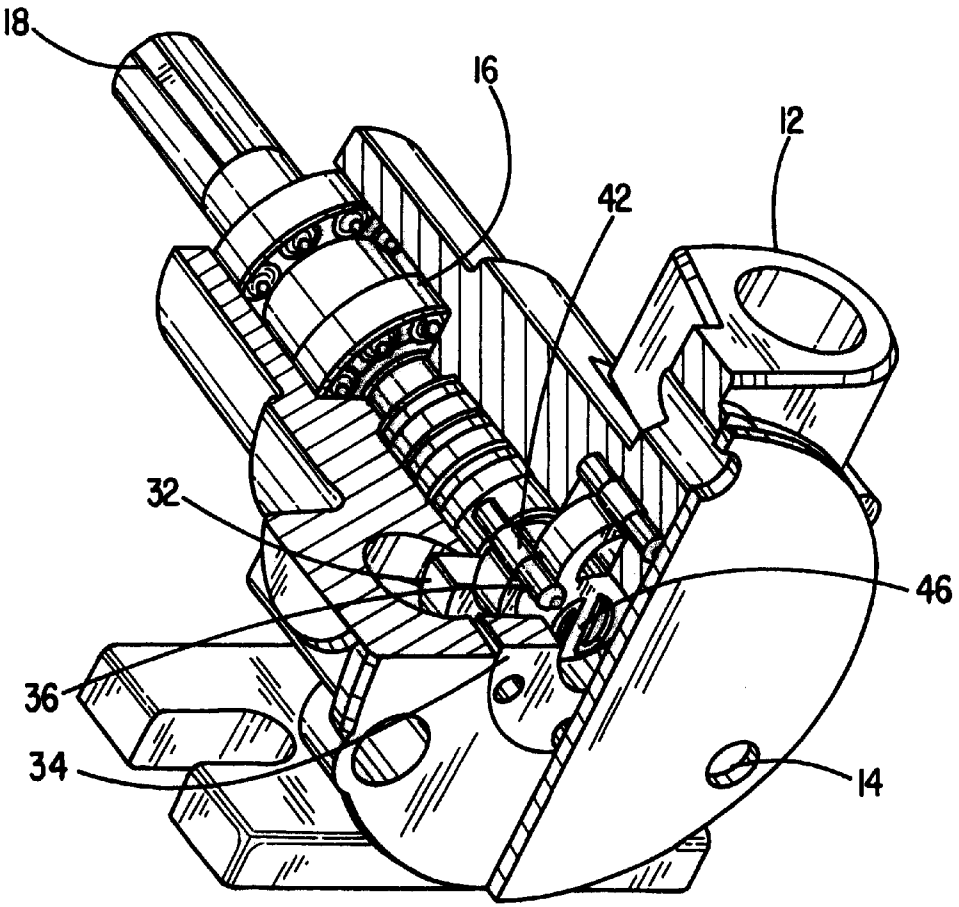
FIG. 3 is a partial sectional perspective view of the high pressure fluid forcing pump of the type shown in FIG. 1, showing the impeller assembly positioned within the cavity of the pump housing.

Referring to FIGS. 2 and 3, the impeller assembly 20 includes an impeller 30, first and second bearing plates 32 and 34 respectively, and engagement pins 36. Without any limitation intended, the housing 12, first and second bearing plates 32 and 34 and impeller 30 may be constructed of known suitable materials with steel being preferred for the housing 12 and engagement pins 36. Without limitation, the impeller 30 is made from an elastomer, for example, Nitrile, EPDM or Neoprene. The first and second bearing plates 32 and 34 are preferably manufactured from wear resistant material, for example, polyetheretherketone (PEEK), Nylon, polytetrafluoroethylene (PTFE). The impeller 30 includes a central hub 38 and a plurality of vanes 40 extending radially therefrom. Each vane 40 terminates in a tip 42, wherein an aperture 41 extends through the tip and is adapted for receiving pin 36. Each corresponding pin 36 is press fit through the tip 42 of the vane 40, such that a first end of the pin 36 aligned within the first bearing plate 32 and a second end of the pin 36 aligns within the second bearing plate 34. Those skilled in the art will appreciate that the impeller 30 and pins 36 may be molded as a single unitary elastomer body. The central hub 38 has a central aperture 44 divided into two subsections by a central lock 46. The central lock 46 is sized to fit and engage in a slit 48 formed in the end of the shaft 18 of the motor 16 and locks the impeller 30 on the shaft 18 as the shaft rotates (see FIGS. 1 and 3).

Figure 4:
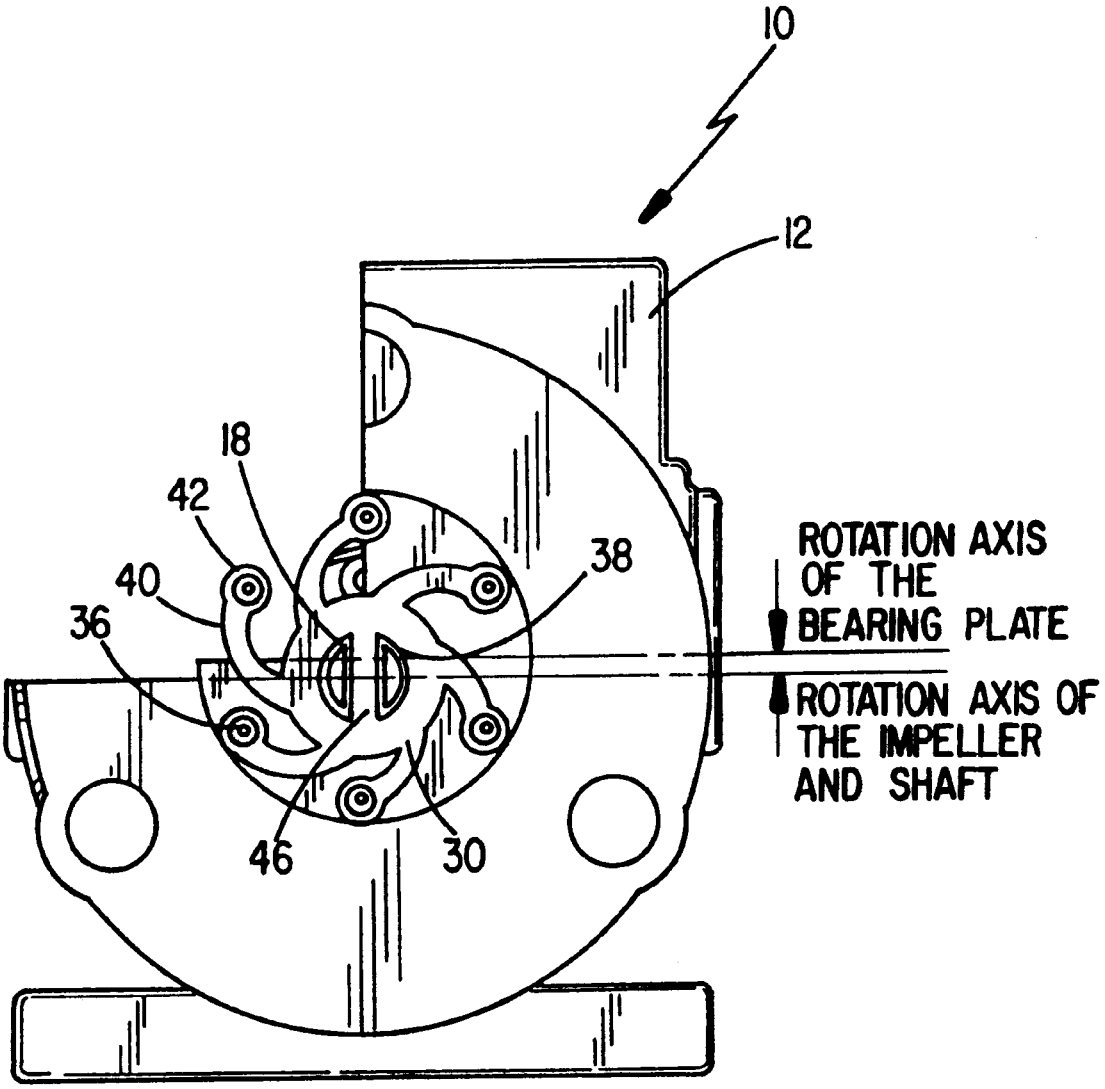
FIG. 4 is a partial sectional fragmented side elevational view showing the eccentricity between the rotational axis of the impeller and the longitudinal axis of the cavity of the housing.

When the shaft 18 is rotated by motor 16, the impeller 30 rotate simultaneously about the longitudinal axis of the shaft 18 within the cavity 22 of the housing 12. The rotational axis of the first and second bearings plates 32 and 34 is aligned with the longitudinal axis of the cavity 22 (see FIG. 4). In this manner, the vanes 40 are forced inward as the impeller assembly 20 rotates through a portion of a complete revolution. The inlet 26 and outlet 28 are positioned adjacent the cavity 22 such that as the impeller assembly 20 rotates through a complete revolution, the vanes 40 of the impeller assembly 20 are compressed inward as they rotate towards the outlet 28 and extend outwardly as they rotate past the outlet 28. In this manner, the pressure of the fluid increases as it is forced through the outlet 28 by the rotating impeller assembly 20. The position of the pins 36 in the bearing plates 32 and 34 determines the maximum amount of flex of the vanes 40, and inhibits slippage as the pressure within the housing increases.

This invention has been described herein in considerable detail in order to comply with the patent statutes and to provide those skilled in the art with the information needed to apply the novel principles and to construct and use such specialized components as are required. However, it is to be understood that the invention can be carried out by specifically different devices, and that various modifications, both as to the equipment details and operating procedures, can be accomplished without departing from the scope of the invention itself

What is claimed is:

1. A high pressure fluid forcing pump having an impeller operable at high pressures, said pump including:

(a) a motor having a rotatable shaft extending therefrom;

(b) a housing having a cavity formed therein and further having a spaced apart inlet and outlet each extending from an outer surface of said housing into the cavity of said housing, wherein said cavity is adapted for receiving an impeller assembly;

(c) said impeller assembly including a central hub attached to said rotatable shaft of said motor and having a plurality of vanes extending radially from said central hub and terminating with a plurality of respective tips, wherein first and second spaced apart bearing plates align and engage said central hub and vanes therebetween, said impeller assembly further including a plurality of pins corresponding with the plurality of vanes, wherein each corresponding pin extends through a tip of the vane such that a first end of the pin is rigidly affixed to said first bearing plate and a second end of the pin is rigidly affixed to said second bearing plate, wherein said central hub and said shaft rotate simultaneously within the cavity of said housing.

2. The high pressure fluid forcing pump as recited in claim 1, wherein said shaft of said pump and said first and second bearing plates rotate on offset axis.

3. The high pressure fluid forcing pump as recited in claim 2, wherein the central hub of said impeller assembly is adapted for receiving and engaging an end of the rotational shaft of the high pressure fluid forcing pump, said end of said rotational shaft having a slit extending through the end of said rotational shaft.

4. An impeller assembly to be disposed in a high pressure fluid forcing pump, said impeller assembly including:

(a) a central hub;

(b) a plurality of vanes extending radially from said central hub and terminating with a plurality of respective tips;

(c) first and second spaced apart bearing plates aligned and engaging said central hub and vanes therebetween; and (c) a plurality of pins corresponding with the plurality of vanes, wherein each corresponding pin extends through the tip of the vane and a first end of the pin is rigidly fixed to said first bearing plate and a second end of the pin is rigidly fixed to said second bearing plate, wherein said central hub and said first and second spaced apart bearing plates rotate simultaneously.

5. The impeller assembly as recited in claim 4, wherein the central hub is adapted for receiving and engaging an end of a rotational shaft of the high pressure fluid forcing pump having a slit extending through the end of said rotational shaft.

6. The impeller assembly as recited in claim 4, wherein said impeller is engaged within a housing of the high pressure fluid forcing pump.

7. An impeller assembly to be disposed in a high pressure fluid forcing pump, said impeller assembly including:

(a) a central hub having a central aperture extending therethrough and said aperture divided into subsections by a central locking member;

(b) a plurality of vanes extending radially from said central hub and terminating with a plurality of respective tips;

(c) first and second spaced apart bearing plates aligned and engaging said central hub and vanes therebetween; and (c) a plurality of pins corresponding with the plurality of vanes, wherein each corresponding pin extends through the tip of the vane and a first end of the pin is rigidly fixed to said first bearing plate and a second end of the pin is rigidly fixed to said second bearing plate, wherein said central hub and said first and second spaced apart bearing plates rotate simultaneously.

8. The impeller assembly as recited in claim 7, wherein the central hub is adapted for receiving and engaging an end of a rotational shaft of the high pressure fluid forcing pump having a slit extending through the end of said rotational shaft.

9. The impeller assembly as recited in claim 7, wherein said impeller is engaged within a housing of the high pressure fluid forcing pump.

10. A high pressure fluid forcing pump having an impeller operable at high pressures, said pump including:

(a) a motor having a rotatable shaft extending therefrom;

(b) a housing having a cavity formed therein and further having a spaced apart inlet and outlet each extending from an outer surface of said housing into the cavity of said housing, wherein said cavity is adapted for receiving an impeller assembly;

(c) said impeller assembly including a central hub attached to said rotatable shaft of said motor and a plurality of vanes extending radially from said central hub and terminating with a plurality of respective tips, wherein each respective tip is rigidly affixed to first and second spaced apart bearing plates, such that said central hub and said first and second spaced apart bearing plates rotate simultaneously within the cavity of said housing, said central hub having a central aperture extending therethrough and said aperture being divided into subsections by a central locking member.

11. The high pressure fluid forcing pump as recited in claim 10, wherein said shaft of said pump and said central hub rotate on a same axis.

12. The high pressure fluid forcing pump as recited in claim 11, wherein the central hub of said impeller assembly is adapted for receiving and engaging an end of the rotational shaft of the high pressure fluid forcing pump, said end of said rotational shaft having a slit extending through the end of said rotational shaft.

13. The high pressure fluid forcing pump as recited in claim 10, wherein said shaft and said central hub have a same first rotation axis and said first and second spaced apart bearing plates have a second rotation axis offset from said first rotation axis.

* * * * *